US005606142A

United States Patent [19]

Volpp

[11] Patent Number: 5,606,142

[45] **Date of Patent: *Feb. 25, 1997**

[54] SHELL RESONANT MEMBRANOPHONE

[75] Inventor: Steven Volpp, Meridian, Miss.

[73] Assignee: Peavey Electronics Corporation, Meridian, Miss.

[ * ] Notice: The term of this patent shall not extend beyond the expiration date of Pat. No. 5,353,674.

[21] Appl. No.: 269,112

[22] Filed: Jun. 30, 1994

Related U.S. Application Data

[63] Continuation-in-part of Ser. No. 2,753, Jan. 13, 1993, Pat. No. 5,353,674.

[51] Int. Cl.[6] ..... G10D 13/02

[52] U.S. Cl. ..... 84/411 R

[58] Field of Search ..... 84/411 R, 414

[56] References Cited

U.S. PATENT DOCUMENTS

| | | | |
|---|---|---|---|
| 3,724,313 | 4/1973 | Frigo et al. | 84/411 R |
| 4,356,757 | 11/1982 | Mooy | 84/411 R |
| 4,448,105 | 5/1984 | Cordes | 84/413 |
| 4,475,434 | 10/1984 | Willis | 84/411 R |
| 4,570,522 | 2/1986 | May | 84/421 X |
| 4,589,323 | 5/1986 | Belli et al. | 84/411 R |
| 4,616,552 | 10/1986 | Jang | 84/414 |
| 4,619,179 | 10/1986 | Wright | 84/413 |
| 4,928,565 | 5/1990 | Hsieh | 84/411 R |
| 4,993,304 | 2/1991 | Lovelet | 84/411 R |
| 5,025,697 | 6/1991 | May | 84/411 R |

FOREIGN PATENT DOCUMENTS

| | | |
|---|---|---|
| 496281 | 10/1919 | France . |
| 494467 | 3/1930 | Germany . |
| 4108792 | 9/1992 | Germany . |

*Primary Examiner*—Cassandra C. Spyrou

*Attorney, Agent, or Firm*—Watson Cole Stevens Davis, P.L.L.C.

[57] ABSTRACT

A drum having improved acoustic characteristics includes a rigid annular bridge at one or both ends of a thin resonant annular shell attached to the bridges. A drum head is mounted on the bridge by a tension mechanism attached only to the bridge, and the drum is mounted on a drum stand by mounting hardware attached only to the bridge, leaving the shell free of load bearing and tensive and compressive forces and making the shell resonate more effectively. The bridge is machined from a solid block of wood formed of horizontal laminations. A microphone can be mounted on the inside of the bridge, with electrical leads exiting the drum through the mounting hardware. A snare drum having a thick body instead of a resonant shell is machined in the same way and has internal head tension members that make it possible to have a thicker body.

14 Claims, 7 Drawing Sheets

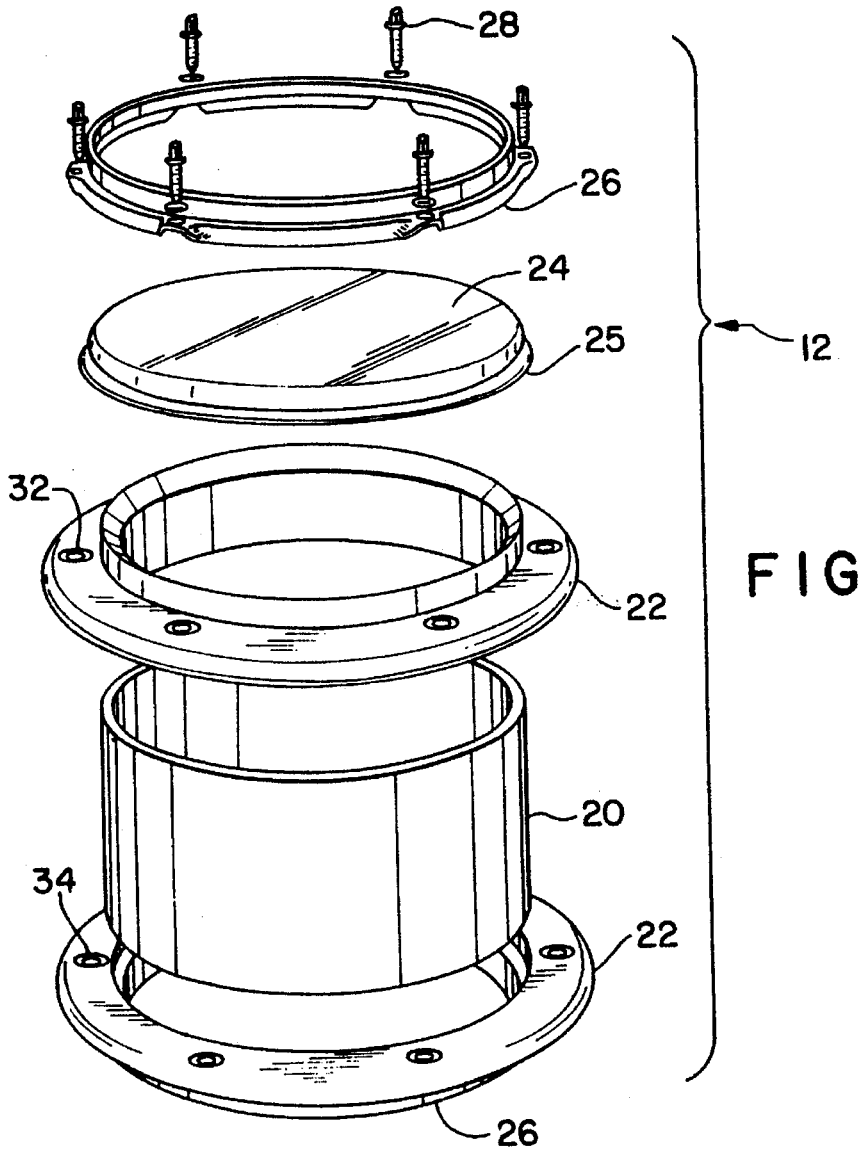
FIG.1
FIG.2
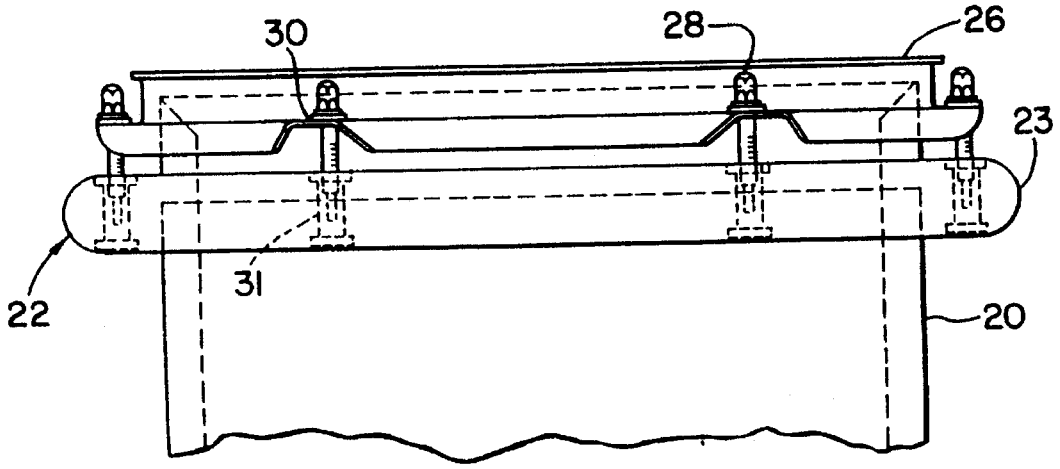

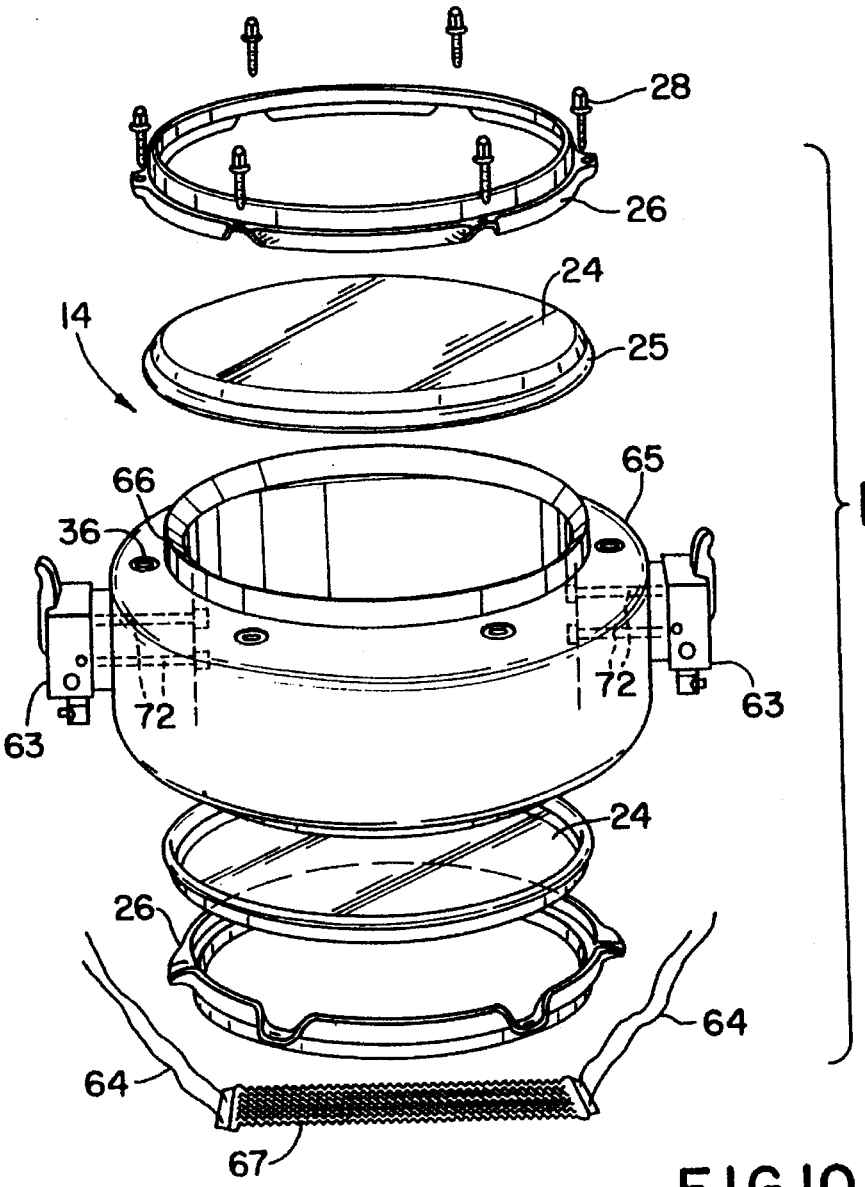
FIG.8
FIG.10
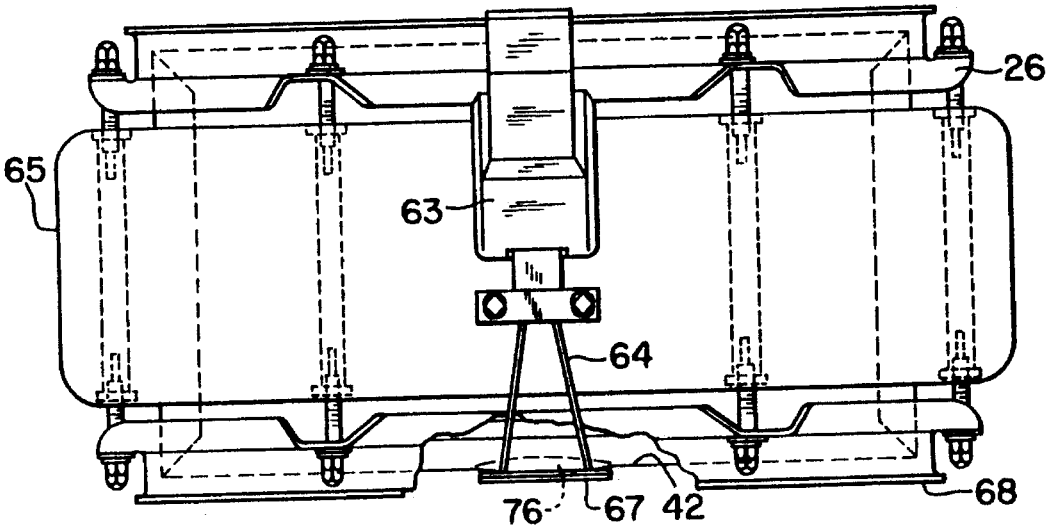

SHELL RESONANT MEMBRANOPHONE

CROSS-REFERENCE TO RELATED APPLICATION

This is a continuation-in-part application of application Ser. No. 002,753, filed Jan. 13, 1993 now U.S. Pat. No. 5,353,674.

BACKGROUND OF THE INVENTION

This invention relates to an acoustical membranophone or drum which produces an audible musical sound when struck by an object such as a drum stick. More particularly, this invention relates to a drum in which the tensive and compressive forces associated with tuning and mounting hardware do not restrict the free resonation of the drum shell, and to a bridge which is employed in such a drum. This invention also relates to the manufacture of a snare drum having an improved snare response and a minimum of snare buzz.

Acoustical drums have uniquely influenced history and trace their origin as far back as the Stone Age. Archaeologists have discovered artifacts showing drums in ancient cultures such as Samaria, Mesopotamia, and Babylonia. These artifacts date into the third millennium B.C. Drums have since been used for such diverse purposes as communication and religious ceremonies. In the Fifteenth Century A.D., King Edward VI introduced the drum into the English Army. By the Seventeenth Century, the capture of an enemy's kettledrums signaled that the battle was won. Today, the drum finds a plethora of applications ranging from military marching to the production of orchestral music. Virtually all styles of modern music use drums or an equivalent to keep rhythm.

Drums produce their sound through the striking of a membrane or drum head which has been tightly stretched over a supporting structure such as a drum shell. The drum shell may be of a variety of shapes and is generally cylindrical in nature. Drum shells are usually made from bent wood such as plywood and are typically ¾ of an inch to over an inch in thickness. Occasionally drums may be made with thinner shells. The bent wood is difficult to form in a precise circle and has a tendency to deform based upon climatic conditions. At a minimum this deformation necessitates retuning and at a maximum necessitates replacement of the drum itself. Depending upon its design, the drum shell may have an end opposite the membrane which is either open, closed, or covered by another similar membrane. When the drum is configured to have a membrane stretched over opposite ends of a tubular drum shell, it is technically referred to as a bimembranophone. More commonly, drums are called tom drums, bass drums, or snare drums.

The membrane was traditionally configured from animal leather which would shrink to fit the drum structure. With this primitive technology, various methods were employed to affix the membrane to an end of the drum structure or bearing edge. The membrane has been: glued to the drum shell, tacked to the drum shell, buttoned to the drum shell, laced to the drum shell, laced to a membrane on the opposite side of the drum shell, and braced to an oppositely positioned membrane. When the membrane is braced, a rigid rim covers the membrane and is tightened for form a brace with a similar, oppositely placed rim.

More recently, the membrane has been manufactured from a thin plastic material having a semi-flexible circular rigid bead mounted on a peripheral edge. The rigid bead is generally made from aluminum and is permanently fastened to the thin plastic material with an epoxy adhesive. The thin plastic material is usually made from mylar.

However, the basic drum design has remained unchanged. The rigid bead is still pulled over the bearing edge at the end of the drum shell and is removably affixed thereto by the rim. The thin plastic membrane is thus formed into a resilient resonant surface.

To hold the rigid bead onto the bearing edge by the rim, various forms of tuning hardware have been employed. The tuning hardware is traditionally affixed to the shell of the instrument. Rigid members, usually made from threaded rod, extend from the rim and are removably fastened into a plurality of metal fasteners incorporated in mounting blocks which are permanently affixed to the drum shell. By tightening the threaded rods into the metal fasteners, a tensive force is applied to the rim and accordingly, across the drum head. The weight of the tuning hardware on the drum shell has the effect of dampening any resonance produced by the drum shell. Additionally, the portion of the drum shell between the tuning hardware and the rim is under a dampening compressive force.

By varying the tensive force applied by each of the metal fasteners, the membrane will vary in tone when struck. Adjustment is commenced until an appropriate tone is achieved. To support the force placed on the tuning hardware, the shell must be made of a sufficient thickness. The ability of the shell to resonate in harmony with the drum head decreases as the thickness of the shell is increased. To achieve a drum shell which will sufficiently support the tuning hardware, it is common to use a drum shell thickness of about ¾ inch or greater, although thinner shells have been used from time to time with mixed success, and generally these are reinforced at support points. This significantly decreases the amount of shell resonance.

In an alternative method, elongated tension members are fastened between rims which are removably attached to opposite ends of the drum shell. The members may be rigid such as threaded rod, or flexible such as leather lace. The membrane is secured and tuned by tightening the members into the oppositely positioned rims. In the case of the threaded rod, each member is individually tightened or untightened until an appropriate tone is reached. As the rigid members are tightened, a compressive force has the effect of dampening the resonation of the drum shell. Additionally, the drum shell must be made of sufficient thickness such that it will not fracture under the compressive load. The amount of thickness to thwart a fracture is such that the amount of shell resonance is markedly decreased.

Drums of varying size are often combined to form a set. To afford playability and enhance the sound quality, the drums are often mounted above the floor in a close configuration. To hold the drums above the floor they are often affixed to stands or each other by mounting hardware. The mounting hardware is traditionally affixed to the shell of the drum. The drum shell must then be of a sufficient thickness to support the heavy weight of the drum without warping or cracking. This added shell thickness along with the weight of the mounting hardware severely dampens the resonation of the drum shell.

Another type of membranophone, which is strictly a bimembranophone, is the snare drum. The snare drum is a relatively small double membrane drum which is easily carried or placed on a stand. Its diameter is greater than its height or thickness, and snares are added across the bottom membrane. Alternate sides of the bottom of the snare drum are scalloped to form a snare bed. This snare bed reduces the snare buzz.

Snare drums are traditionally made from short tom tom shells. The shells are constructed from bent wood in accordance with traditional drum manufacture. The bent wood is difficult to form in a precise circle and is easily subject to warping due to the tension from the two drum heads and varying climatic variations. Reinforcing hoops are usually placed around the snare drum shell to provide added support.

The snares are grouped in parallel strips across the lower membrane and produce a rattling or reverberating effect when the upper membrane is struck. A snare is a string of spiraled metal which contacts a drum membrane. The correct height adjustment of the snares is difficult to achieve causing the snares to "buzz."

SUMMARY OF THE INVENTION

A drum according to the present invention includes essentially four different components: a drum head, a rim, a bridge, and a shell. The head, rim and bridge can be provided on one or on both opposing ends of the cylindrical shell. The invention is also directed to the bridge component which, together with the rim, positions the head relative to the shell.

The drum shell is not merely a cylinder that supports the heads; it is a resonator designed to obtain maximum sonority from the vibration of the head. The wooden drum shell of the present invention is made substantially thinner than a traditional wooden drum shell. Since the drum shell vibrates more freely as the wall becomes thinner, the wooden drum shell thickness should be ¾ of an inch or less. A thickness of ½ inch or less is preferable and a thickness of ¼ inch or less is even more desirable. The thickness most preferred for the wooden drum shell is about ⅛ inch. This allows enough strength to sufficiently support the accompanying structure while allowing free resonation of the drum shell in harmony with the drum head. The minimum thickness is the thickness necessary to support the weight of the bridges.

When fabricated from wood laminations (which is preferred) the shell is made from 4 or 5 plies of wood, with each ply being about 0.031 inches thick. These are glued together to form a thickness of about ⅛" to 0.155 inches. The wood is bent and glued into the shape of a cylinder. The plies are cross laminated.

While wood is an especially popular material for manufacturing drums and is generally preferred for sound quality, other materials such as plastics or metal can be used for the shell instead of wood if desired. Such materials can produce differences in sound quality, but they are structurally satisfactory and may, depending upon the material, be fabricated into a useful drum shell having a thickness as low as 0.05 inch. The drum shell can be formed of combinations of wood, plastics and metal, such as plastic covered with a veneer of wood.

A bent wood drum shell "remembers" its original shape, that of a flat board, and therefore is difficult to form with a perfectly circular edge and maintain the circular edge over its useful life. However, the present drum shell is held to a near perfect circumference through insertion into the bridges at either end. The shell fits tightly into the bridge.

This bridge caps the end of the drum shell and is not found in traditional drums. This provides stability to the structure, maintenance of exacting specifications, and a sharp bearing edge. Moreover, it reduces tensive and compressive stresses on the shell and relieves the shell of virtually all load bearing duties. The ends of the shell extend into the bridge and are glued therein. The bridge itself preferably is made from cross laminated plywood formed from a hardwood such as hard maple and is precisely machined. The outer end of the bridge is machined at a 45° angle using CNC technology. There is no counter cut. This sharp conical edge reduces the amount of surface area which contacts the rim and forms a reduced friction bearing edge.

The CNC machining process, along with the cross laminated plywood allows a true 45° cut to form the bearing edge. This allows a true free floating head. Traditional drums, which use the rim to press the head directly onto the drum shell, have attempted the 45° cut but have to round or counter cut the tip (or bearing edge) to a 3/16 inch circle. The present invention has a precisely machined bridge along with a near perfect shape. This near perfectly shaped circular bridge facilitates the formation of even ordered harmonics which are pleasing to the ear. The bridge according to the present invention allows the use of a conventional rim and a conventional mylar drum head. Alternatively, the bridge can be formed of plastic or metal instead of wood, if desired, or combinations of these materials.

The bridge according to the present invention also serves as the tension and mounting point for all tuning and mounting hardware. The tuning and mounting hardware are not mounted on the drum shell, which allows more free resonation. The bridge is annular and has a flange below the bearing edge which protrudes outwardly. The width of the bridge flange desirably is approximately 1 and ¼ inch. The flange has a series of holes which extend downwardly through the flange (perpendicular to the plane of the drum head). These holes are spaced so as to be aligned with the tension rod openings in a conventional drum rim which is standard in the industry. The conventional rim presses the drum head onto the bridge via threaded rods which pass through the rim and are attached to the bridge flange.

The drums may be attached to stands or each other through mounting hardware. The mounting hardware is a modified C-clamp made from chrome plated aircraft aluminum and is configured to fit around the bridge flange. The mounting hardware accepts a standard one inch drum mounting rod, which is in turn attached to a conventional drum stand. The rod is allowed to extend through the bridge and into the interior of the drum. This allows the placement of the drum in a variety of locations relative to the other drums and stands. A gooseneck mount is also placed on the mounting hardware to allow placement of a microphone gooseneck.

A snare drum is also disclosed in accordance with the present invention. Unlike traditional snare drums, the present snare drum is not fabricated by bending and gluing plywood laminations together. Instead, it is machined from a solid block of wood. As the term is used herein, a "solid block of wood" can be one integral piece of wood or can be formed of several pieces or blocks of wood glued or bonded together in a butcher block type of configuration. This block forms both the bridge and the snare body. Again, the snare drum body could be formed of other materials such as plastic or metal or combinations thereof.

The bridge of the snare drum is cut the same as the tom drum, with the flange extending downward to form the snare body. No interior cut for the insertion of a shell is used as in the tom drum. The thickness of the drum shell is allowed by be 1 and ¾ inches thick or greater. As opposed to the tom drum, a thicker shell is more acoustically desirable for the snare drum. Sitka Spruce may be used as the wood source. Sitka Spruce cannot be bent but is acoustically resonant. Sitka Spruce is used for fine piano soundboards.

Machining the snare drum from a block of wood also allows precise control of the snare bed. The snare bed scallop is cut into the bottom bridge before the 45° bevel is cut. Each scallop is approximately three inches in circumferential length around the bridge. The scallop is shallow and only ⅛ inch at its deepest point. This reduces the amount of snare buzz.

The traditional drum is finished with a glued on laminated wrap or a hard lacquer finish. This reduces the free resonation of the shell. Both types of drums of the present invention are first stained with an alcohol based stain to which a colorful tint can be added. The stained drum is then top finished with linseed oil or an equivalent. This improves the ability of the shell to freely resonate in harmony with the drum head.

One of the important advantages of a drum using the bridge and shell of the present invention is that the decay of the sound is uniform and very consistent. The clear and consistent tone evidences the reduction of unwanted odd order harmonics. The shell vibrates with the drum head. For a standard drum, the shell does not vibrate with the drum head. A turbulent and inconsistent pattern develops which produces odd ordered harmonics, a unpleasant sound, and an inconsistent decay.

With the present invention the reduced friction of the bearing edge promotes the free resonation of the drum membrane. The resonance dampening effect of mounting the tuning and mounting hardware on the shell is avoided. The bridge is rigid and resists deformation. The compressive force placed on the shell due to tuning hardware tension is virtually eliminated. The tuning and mounting hardware is removed from the shell, thereby increasing the ability of the drum shell to freely resonate. The free resonation of the drum shell is increased by reducing its required thickness.

The advantages of the snare drum of the present invention also include a reduced friction bearing edge and resistance to change in shape of the shell due to varying climatic conditions. Another important advantage is that internal capture of the tension rods inside the outer surface of the body or shell permits the use of a thicker body than is possible with traditional externally mounted tuning hardware. This makes it possible to increase the mass of the body, which raises the timbre of the shell.

These and other objects and advantages will become apparent from the following description of the invention taken together with the accompanying drawings.

BRIEF DESCRIPTION OF THE DRAWINGS

FIG. 1 is an exploded perspective view of a tom drum of the present invention, showing the rim, head, bridge and shell.

FIG. 2 is a side view of one end of a tom drum showing the head and shell mounted to the bridge.

FIG. 8 is an exploded perspective view of the snare drum of the present invention.

FIG. 10 is a side elevational view of a snare drum with a portion being broken away to show the placement of the snare bed.

DETAILED DESCRIPTION OF THE PREFERRED EMBODIMENT

Figure 3:
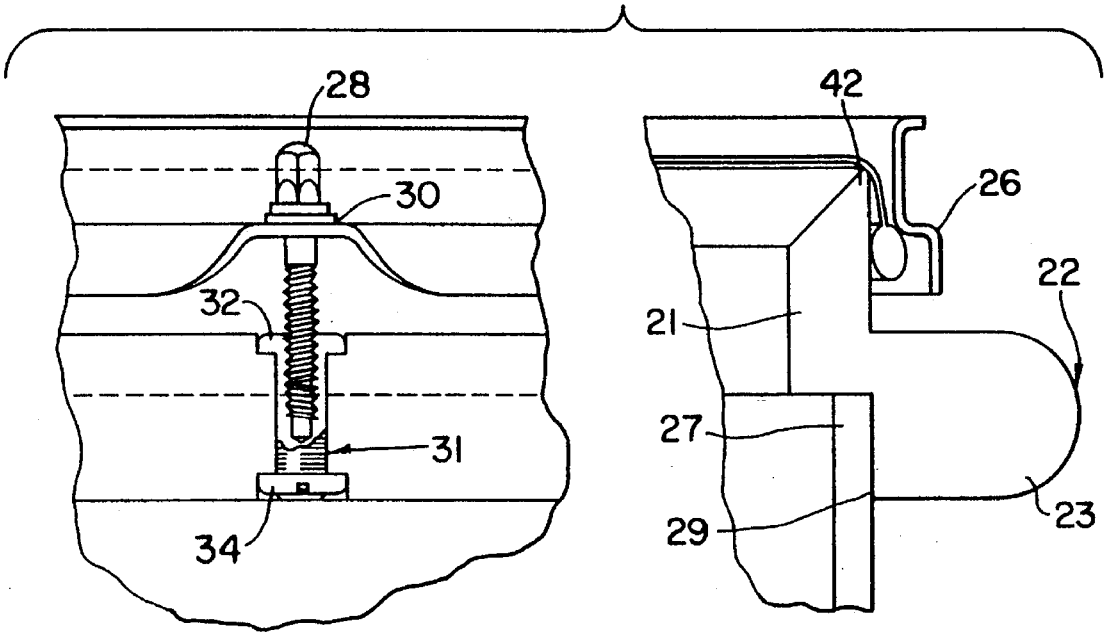
FIG. 3 is fragmentary and partially sectional elevational view of the bridge.

Referring to the drawings and more particularly to FIGS. 1–3, a tom drum 12 is provided in accordance with the present invention. The tom drum has a shell 20, a bridge 22 at each end, and a head 24 and a rim 26 mounted on each bridge. For illustration purposes a tom drum is described. This is the same structure as a bass drum, with the exception that the bass drum is usually mounted with the drum heads vertical and is operated with a drum pedal. The bridge 22 is permanently glued to the shell 20. The rim 26 firmly secures the head 24 to bridge 22 by threading tension rods 28 into the bridge 22. Rim 26 and head 24 are conventional. Head 24 is permanently attached to bead 25 which is used to secure the head to the bridge 22. A representative top head is the Evans Uno 58 coated White 750 Top. A representative bottom head is the Remo Weather King Ambassador Batter.

Tension rods 28 are metal and are relatively short due to their attachment to the bridge flange 23 rather than the drum shell. Tension rods 28 are secured into internally threaded tension lugs 31, which are mounted in openings in the bridge. The number of tension rods varies with the diameter of the drum according to Table 1:

TABLE 1

| Drum diameter in inches | Number of tension rods/lugs |
|---|---|
| 8 | 4 |
| 10 | 6 |
| 12 | 6 |
| 14 | 6 |
| 16 | 8 |
| 18 | 8 |
| 20 | 8 |
| 22 | 10 |
| 24 | 10 |

Referring to FIG. 1 and FIG. 2, drum shell 20 for the tom drum is cylindrical and made from bent wood. Four or 5 plies of soft maple 0.031 inch thick are cross laminated to form a total thickness of about ⅛ inch (actually about 0.125 to about 0.155 inches). Drum shell 20 is inserted and glued into bridge 22. The drum shell 20 extends into bridge 22 about one-half inch or so. This provides an adequate side surface for bonding bridge 22 and shell 20.

FIG. 2 is a side view showing the tension rods 28 inserted through washers 30 and into tension lugs 31. Tension rods 28 have a square shaped head to be used with a standard drum key. Tension rods 28 are frequently removed by the user to replace the drum head and are individually tightened to tune drum head 24. Metallic tension lugs 31 are removable from the flange but are not usually removed or adjusted by the user.

Referring to FIG. 3, a side view of the tom drum tuning hardware is shown. Tension lug 31 is composed of two pieces, spanner bolt 32 and spanner nut 34. Spanner bolt 32 has a flat head and is counter sunk into the inner side of flange 23 of bridge 22. Spanner bolt 32 extends the entire length of the flange and is threaded into spanner nut 34. Spanner nut 34 requires a spanner screwdriver to tighten onto spanner bolt 32. The flange 23 is counter sunk at the outer side to allow flush placement of spanner nut 34 in an opening in the flange. Spanner bolt 32 is drilled and threaded internally to allow threading of tension rod 28 thereto. Thus, tension rod 28 passes through washer 30, rim 26, an air space, and then into spanner bolt 32 of tension lug 31, which is contained in the flange of bridge 22. It is possible to omit use of the tension lug 31 and to instead connect the tension rod 28 to the flange by a threaded hole provided in the material of the flange.

Figure 4:
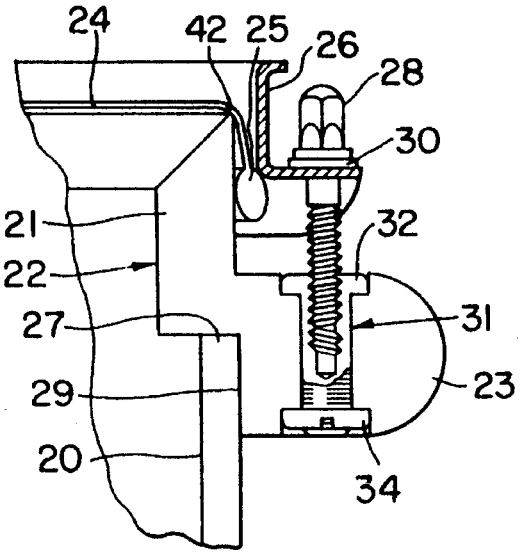
FIG. 4 is a sectional view of the bridge of the tom drum showing the rim, head, bridge and shell along with the tuning hardware.

Referring to FIGS. 3 and 4, a sectional view of the bridge showing the tuning hardware connected to the bridge is shown. Shell 20 extends one-half inch into bridge 22. Bridge 22 is cut with a 45° bevel at the outer end to form bearing edge 42. Drum head 24 is pulled over bearing edge 42 and held in place by rim 26.

Bridge 22 is machined from a solid block of hard maple. The maple block is formed from cross laminated, horizontally oriented plies for added stability. The thickness of the upper portion or neck 21 of the bridge is ½ inch, with the bearing edge 42 formed from a 45° bevel cut between the inner and outer circumferential surfaces. The flange 23 is one inch high and is machined with a circumferential groove in the inner edge that extends ½ inch into the flange. This ½ inch groove 29 forms a contact surface with the drum shell. The flange is one and one-quarter inch wide in a radial direction with a semi-circular outer edge. The diameter of the groove 29 is only slightly greater than the outside diameter of the drum shell in order to insure a snug fit. The shell is forced into the bridge and glued in place.

Figure 5:
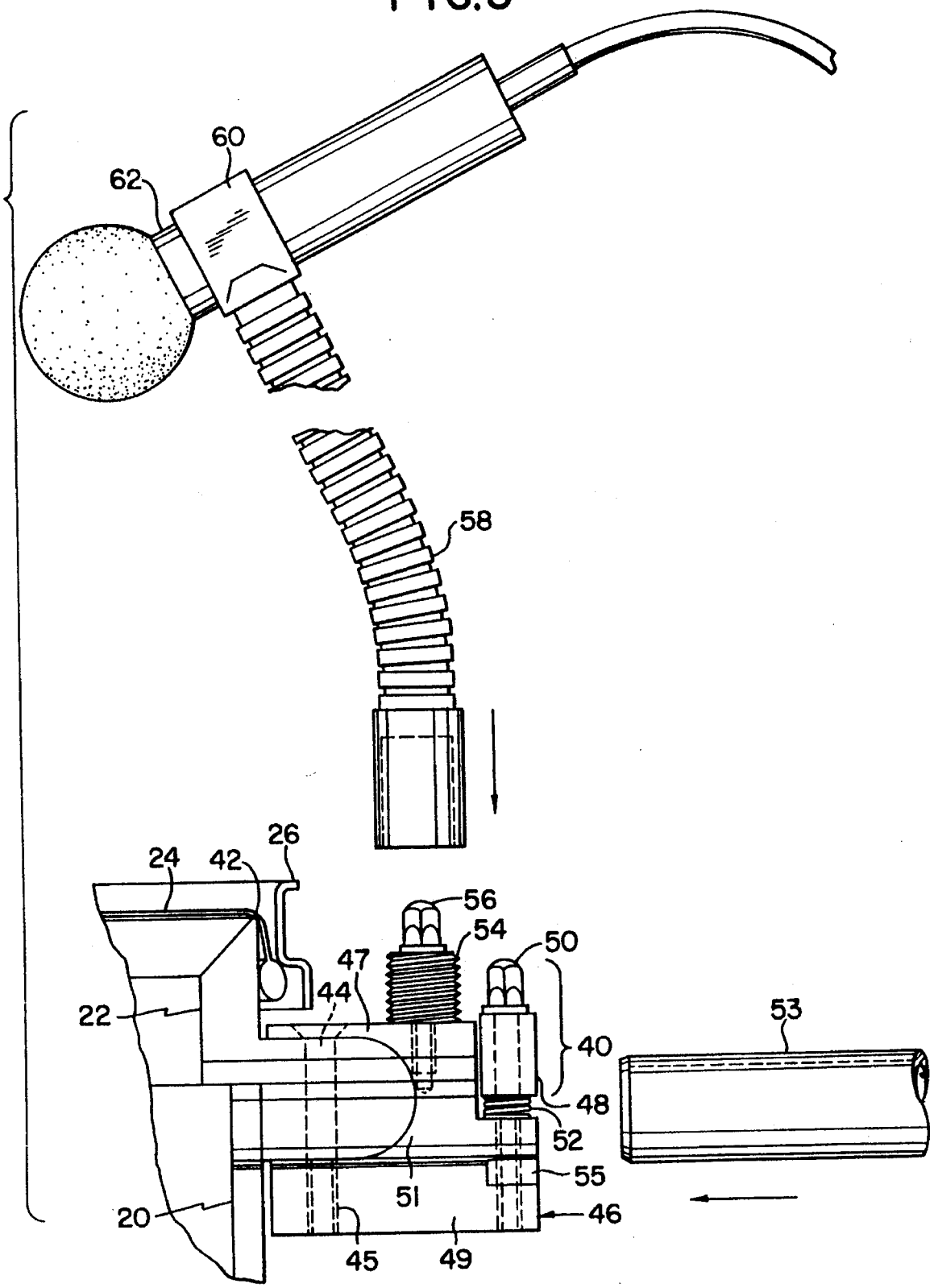
FIG. 5 is a sectional view of the bridge with mounting hardware and microphone gooseneck attached.
Figure 6:
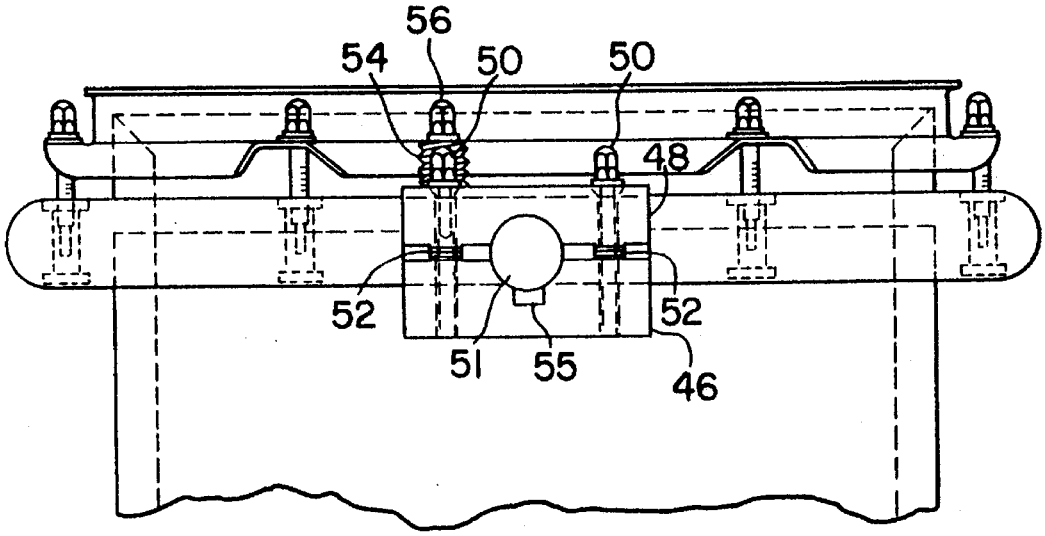
FIG. 6 is a side view of a tom drum showing the face of the mounting hardware.

FIG. 5 shows a cross sectional view of a tom drum with mounting hardware 40 installed. The mounting hardware 40 is placed in a position along the flange 23 of bridge 22 which does not interfere with the tension rods or tension lugs. FIG. 6 shows a side view of the tom drum of FIG. 5 with mounting hardware 40 attached.

Referring both to FIG. 5 and FIG. 6, mounting hardware 40 is shown as a modified C-clamp firmly secured to flange 23 of bridge 22. Although various methods are available for securing the mounting hardware, two countersunk machine screws 44 may be used. The mounting hardware is composed of a base 46 which is affixed to the flange of bridge 22 by machine screws 44. Machine screws 44 extend through the top section 47 of base 46, then through the flange 23, and are then threaded into threaded holes 45 in the bottom section 49 of base 46. The base 46 nearly surrounds flange 23 of bridge 22 but does not come into contact with shell 20. A mounting arm hole 51 extends laterally through base 46 and through bridge 22. The lower end of the mounting arm hole has a key slot 55 which is configured to fit a conventional key member (not shown) found on standard ⅞ inch mounting arms 53. This prevents rotation of the drum on the mounting arm.

A clamp 48 is used to securely affix the standard mounting arm to the base 46. Clamp 48 has an arc in its lower half that fits over a standard mounting arm 53. Both base 46 and clamp 48 are manufactured from aircraft aluminum which is then chrome plated. This is light and strong. Other metals could be used. Two clamp tension rods 50 extend through clamp 48 and are threaded into holes in base 46. Each clamp tension rod 50 has an end which may be tightened or loosened using a standard drum key. Springs 52 surround clamp tension rods 50 between clamp 48 and base 46. Springs 52 help prevent the clamp tension rods 50 from vibrating out during use of the drum.

A gooseneck support 54 is mounted onto base 46 for providing a support for a standard gooseneck 58. Gooseneck support 54 is held in place by a securing bolt 56. Securing bolt 56 has an end which may be tightened or loosened by using a standard drum key. Securing bolt 56 is threaded into a hole in base 46. Gooseneck 58 is standard, 6 inches long, and may be threaded onto gooseneck support 54. A drum microphone 62 may be attached to gooseneck 58 by a standard microphone holder 60.

Figure 7:
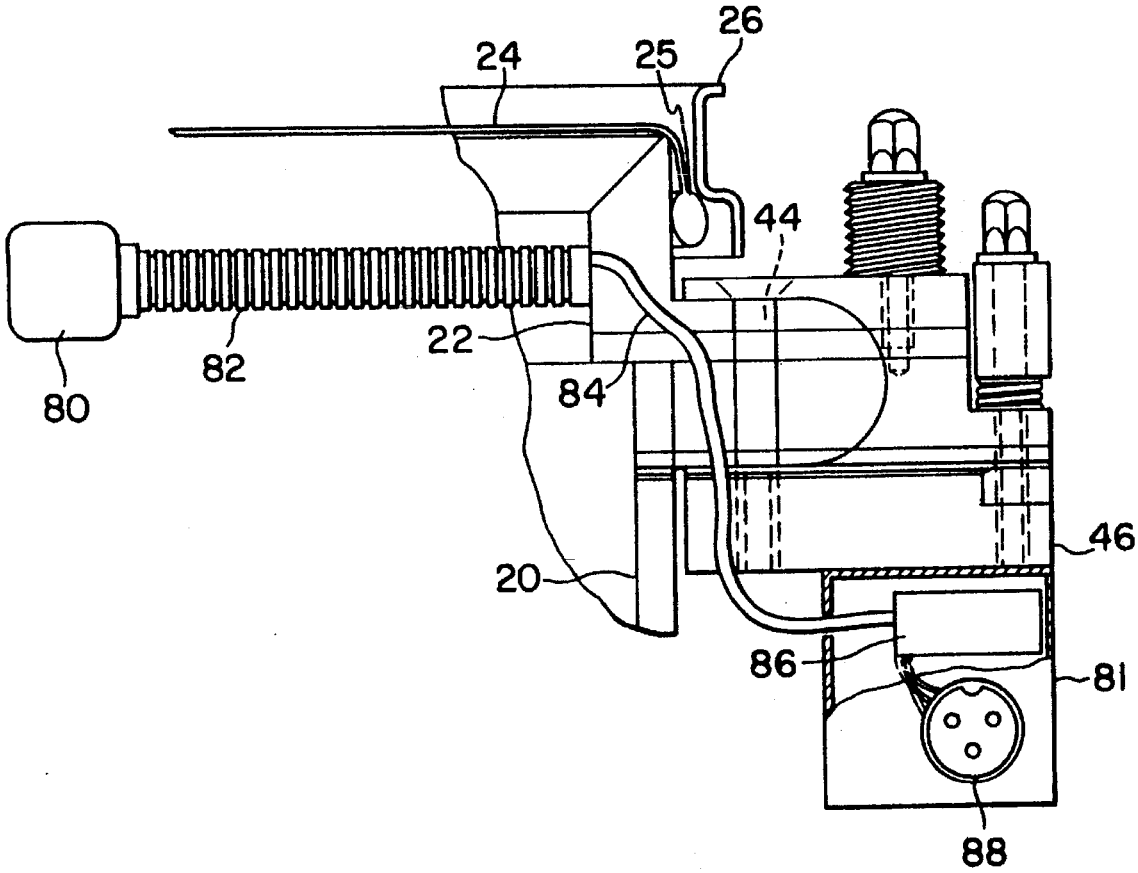
FIG. 7 is a sectional view of the bridge with an internally mounted XLR microphone attached.

FIG. 7 is a partial sectional view of the internal microphone base 81 and internal microphone 80. Internal microphone 80 is mounted on a flexible internal gooseneck 82 which is secured to the interior of bridge 22. Internal gooseneck 82 may be positioned by the user simply by removing the drum rim with a standard drum key. The internal microphone 80 is electrically connected to internal electronics 86 by microphone wires 84. Microphone wires 84 extend from internal microphone 80, through internal gooseneck 82, through bridge 22, through mount 46, into XLR base 81, and then into the internal electronics 86. The internal electronics 86 are then electrically connected to corresponding pins of XLR jack 88.

XLR base 81 is made from aluminum which has been chrome plated. XLR base 81 is attached directly to base 46 of FIG. 5.

Internal microphone 80 requires a FET preamp to operate. This is known as active electronics. Power is supplied to the active electronics through the XLR jack 88 by a method known as phantom power. Two pins of XLR jack 88 are provided with a potential of 36 to 52 volts. The industry standard is 48 volts. This phantom power comes from a mixing board or other source which is connected to the XLR jack 88 by a standard XLR cable. Thus, there is no power source inside internal microphone base 81. Rather, internal electronics 86 are designed to use this phantom power to operate the internal microphone 80 in response to a drum sound.

XLR jack 88 is standard and allows connection to a variety of amplification and recording equipment. XLR jack 88 may also be connected to commercially available circuitry which converts the voltage differential across the XLR pins into a drum trigger signal. This drum trigger signal may then be used in conjunction with sampled sounds, sequencers, and a wide variety of MIDI equipment. Many commercially available musical instruments have XLR drum trigger inputs built in.

FIG. 8 shows an exploded perspective view of a snare drum 14 in accordance with the present invention. The snare drum body or shell 65 desirably is machined from a single block of wood. Alternatively, the body can be formed from two separate blocks forming upper and lower halves of the body, with each block being machined to have an outer end 66 which is the same as the bearing edge sections from FIG. 1 and the two halves are then bonded together to form a single block. This latter construction can be used where the wood working equipment being employed is capable of working on only one end of the body at one time. The shell 20 from FIG. 1 has been eliminated from the body of the snare drum. The thickness of snare body 65 is 1 and ¾ inches but could be greater or lesser. Snare body 65 is more than 10 times thicker than the top drum shell 20. The snare is designed to produce a "crack" sound, thus a massive body is more desirable. The wood for the body may be of almost any variety, including unbendable Sitka Spruce. Other materials such as plastic or metal also could be used, as well as combinations thereof. The snare drum uses conventional rim 26, which allows it to rest on a conventional snare stand.

Figure 9:
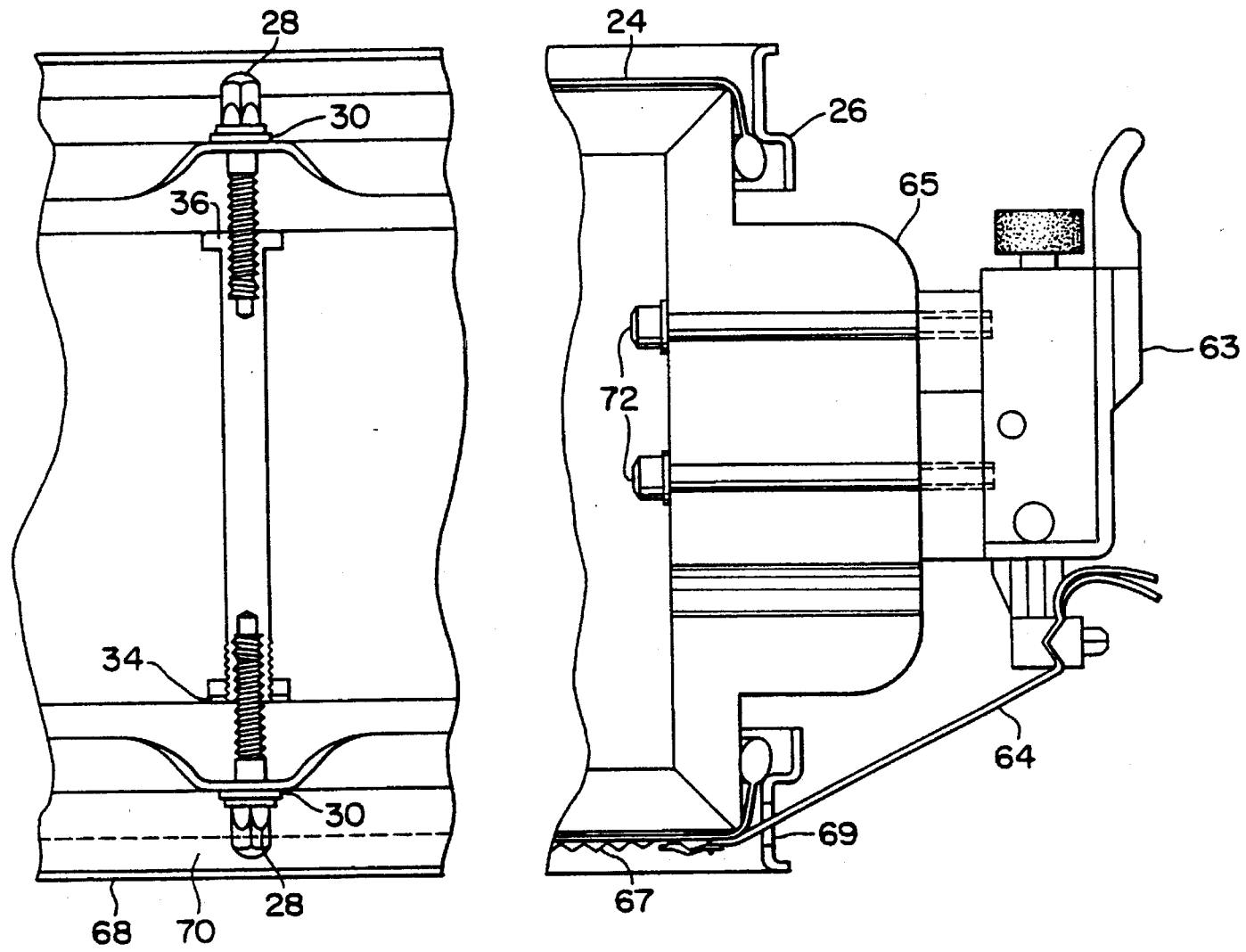
FIG. 9 is a fragmentary and partially sectional side elevational view of the snare drum of FIG. 8.

Referring to FIG. 8 and FIG. 9, strainers 63 are toggle clamps that apply tension to the snares 67 over the bottom head of the snare drum. The strainers 63 are attached to the snare body 65 by strainer bolts 72 which run laterally through snare body 65 and are attached by nuts 74 therein. Cords 64 are attached to strainers 63 and snares 67. The cords 64 extend through the sides of the bottom snare rim before contacting the snares.

Snare spanner bolt 36 extends the entire length of the side wall of the snare drum. Snare spanner bolt 36 is essentially a long version of spanner bolt 32 from FIG. 3. The snare spanner bolt 36 is counter sunk and is secured by spanner nut 34 at the other end. Snare spanner bolt 36 is drilled and threaded at each end to allow insertion of tension rods 28 therein. On the top side, tension rods 28 extend through washers 30, through top rim 26 and into the top side snare spanner bolt 36. On the bottom side, tension rods 28 extend through washers 30, through bottom rim 68 and into the bottom side of snare spanner bolt 36. Bottom rim 68 of the snare drum has holes 69 in the sides into which cords 64 extend to hold snares 67 in place.

The mounting of the tension rods internally in the body provides a significant advantage in the present invention, because it permits the use of a more massive body with a much greater outside diameter. In drums where the tension rods run along the outside of the body, the body thickness cannot be increased beyond the outer circumference limits established by the positions of the tension rods in the rims.

FIG. 10 shows a side elevational view of the assembled snare drum of FIG. 8 and FIG. 9. Snare drum body 65 is shown with bottom rim 68 and head 24 being partially broken away to show the snare mounting. Strainer 63 is shown on snare drum body 65 to show the placement of snare bed 76. Snare bed 76 is a scallop in bearing edge 42 which has been exaggerated to emphasize its shape. Actually, snare bed 76 is an arc cut into the bridge which is three inches in circumferential length around bearing edge 42. The deepest point of the cut extends ⅛ inch below the line of the standard bearing edge 42. The recessed snare bed makes it possible to position the snares closer to the head so that the snares engage the head when it resonates. Because the head 24 on the bottom of the snare is pulled tight over snare bed 76, the head still vibrates with head 24 on the top of the snare.

Figure 11:
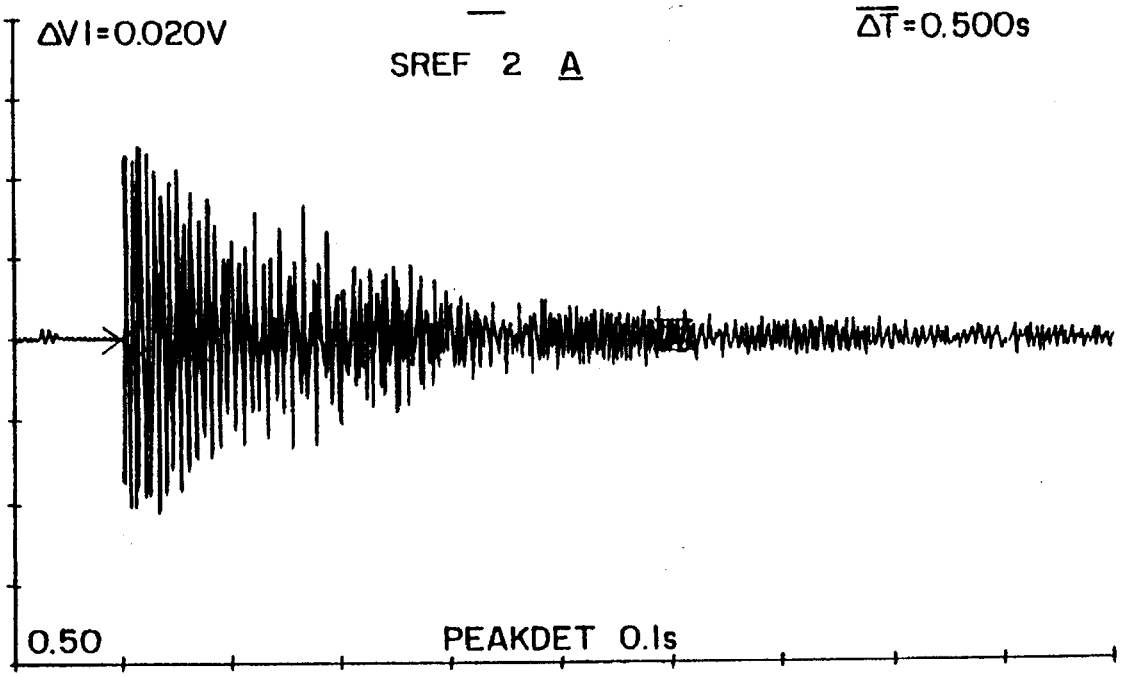
FIG. 11 PRIOR ART
FIG. 11 is a spectral analysis showing the sound pattern of a conventional tom drum.
Figure 12:
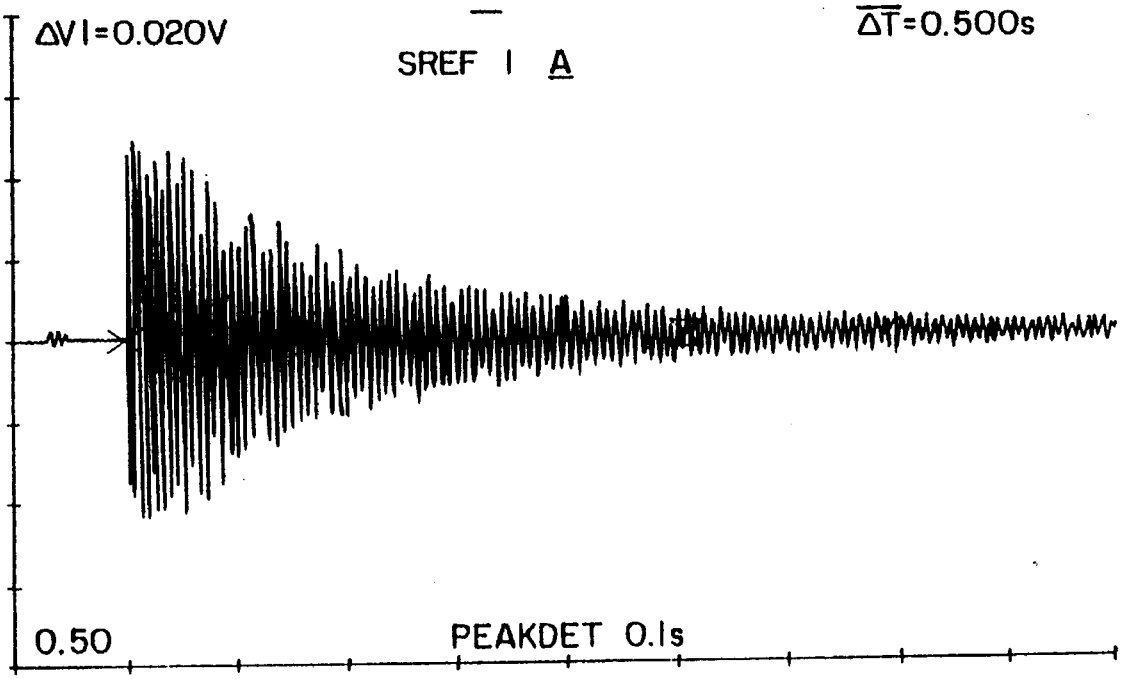
FIG. 12 is a spectral analysis showing the sound pattern of a tom drum according to the present invention.

FIG. 11 is a spectrum analysis for a standard tom drum. FIG. 12 is a spectrum analysis for a tom drum according to the present invention. The horizontal axis represents time in units of one-tenth seconds per block. The vertical axis represents energy in units of 0.02 volts per block. The voltage was recorded by a microphone and each drum was struck with an equivalent force.

The microphone which recorded this spectrum analysis transmits a varying voltage corresponding to the oscillations produced by striking the drum head. The number of oscillations per unit time is perceived by the human ear as a tone. The magnitude of the oscillations is perceived by the human ear as volume. The higher the number of oscillations, the higher pitch of the tone. The larger the magnitude of the oscillations, the louder the volume.

The number of oscillations per unit of time should remain consistent to produce a consistent tone. A constant decay rate in the number of oscillations due to friction is pleasing to the ear. An irregular decay rate in the number of oscillations per unit time indicates the presence of another force conflicting with the drum head vibrations. The other force may be the drum shell vibrating out of synchronism with the drum head as found in that prior art. The traditional drum shell cannot vibrate in synchronism with the drum head due to the dampening effects previously mentioned.

The number of oscillations of the drum head per unit of time as recorded for a standard tom drum (FIG. 11) and a tom drum according to the present invention (FIG. 12) are listed in Table 2:

TABLE 2

| Standard Tom Drum | Inventor's Tom Drum |
|---|---|
| 15 | 15 |
| 15 | 15 |
| 19 | 14 |
| 21 | 14 |
| 26 | 14 |
| 19 | 13 |
| 24 | 13 |
| 16 | 13 |
| 19 | 13 |

Thus, the drum according to the present invention has demonstrated characteristics which are pleasing to the human ear.

Both drums are finished in a nonlacquer finish to allow the wood to more freely resonate along with the head 24. The first part of the finish is a stain which is combined with a tinting agent. By using tints, a variety of colors may be achieved including: clear maple, light maple, medium maple, dark maple, clear blue, clear black, clear green, clear purple, clear orange, clear pink, clear red, and clear yellow. After the stain is applied, a top coat of finishing oil is applied. The finishing oil may be linseed or an equivalent type of oil.

I claim:

1. A membranophone comprising:

an annular bridge having a bearing edge for securing a drum head on an outer end thereof, a drum head fitting over the bearing edge such that a peripheral bead on the drum head is positioned radially outwardly from the bearing edge;

a rim that fits over the outer end of the bridge and is slidable axially inwardly with respect to the bridge, the rim engaging the bead on the head and stretching the head taut over the bridge as the rim is moved inwardly on the bridge;

a tension means connected between said annular bridge and said rim for holding the rim in fixed relation to the annular bridge; and an annular shell nonreleasably secured to an inner end of the bridge and extending inwardly therefrom.

2. A membranophone according to cliam 1, including attachment means to secure said bridge to said annular shell continuously around the inner end of said bridge.

3. A membranophone according to claim 2, wherein said attachment means comprises glue.

4. A membranophone according to claim 3, wherein said inner end of said bridge defines an annular ledge against which an end of said annular shell abuts.

5. A membranophone according to claim 1 wherein said bridge is constructed of cross laminated plywood formed from hardwood.

6. A membranophone comprising;

an annular bearing edge disposed about a peripheral end of the membranophone;

a resilient drum head including a resilient surface and a peripheral head, wherein said peripheral bead is received about the annular bearing edge;

an annular securing rim surrounding said peripheral bead, means to secure said annular securing rim relative to said annular bearing edge and position said resilient drum head taut across the annular bearing edge; and a tubular drum shell nonreleasably attached to and extending inwardly from the annular bearing edge, wherein the wall thickness of the drum shell is no greater than three-sixteenths (3/16 ) inch.

7. A drum according to claim 6, wherein the drum shell has a wall thickness of no greater than one-eighth (1/8 ) inch.

8. A drum according to claim 6, wherein the drum shell has a wall thickness of about 0.05 inch.

9. A membranophone according to claim 6, including attachment means to attach said tubular drum shell to said annular bearing edge continuously around a periphery of said annular bearing edge.

10. A membranophone according to claim 9, wherein said attachment means comprises glue.

11. A membranophone according to claim 10, wherein said annular bearing edge defines an annular ledge against which an end of said tubular drum shell abuts.

12. A membranophone according to claim 9, wherein said annular bearing edge is constructed of cross laminated plywood formed from hardwood.

13. A membranophone bridge comprising:

an annular peripheral flange forming an outward periphery of the membranophone bridge, said peripheral flange having: a top, bottom, outermost periphery and inward side, said bottom of said annular peripheral flange defining a ledge against which an annular membranophone shell is positionable;

a bearing support formed integrally with said peripheral flange, disposed inwardly of the outermost periphery of the peripheral flange and extending upwardly therefrom, said bearing support having a top side; and a bearing surface formed at the top side of the bearing support.

14. A membranophone bridge according to claim 13, wherein said annular peripheral flange is constructed of cross laminated plywood formed from hardwood.

* * * * *